United States Patent [19]

Wanke et al.

[11] Patent Number: 4,648,942

[45] Date of Patent: Mar. 10, 1987

[54] PAPER MACHINE

[75] Inventors: Wilhelm Wanke; Ludwig Hauser, both of Heidenheim, Fed. Rep. of Germany

[73] Assignee: J.M. Voith GmbH, Fed. Rep. of Germany

[21] Appl. No.: 719,280

[22] PCT Filed: Aug. 3, 1984

[86] PCT No.: PCT/EP84/00233

§ 371 Date: Apr. 1, 1985

§ 102(e) Date: Apr. 1, 1985

[87] PCT Pub. No.: WO85/00841

PCT Pub. Date: Feb. 28, 1985

[30] Foreign Application Priority Data

Aug. 4, 1983 [DE] Fed. Rep. of Germany ..... 3328162

[51] Int. Cl.[4] ..... D21F 7/00; D21F 5/04

[52] U.S. Cl. ..... 162/286; 162/193; 162/255; 162/359; 34/117; 226/92

[58] Field of Search ..... 162/193, 255, 286, 359; 34/117; 226/91, 92, 95

[56] References Cited

U.S. PATENT DOCUMENTS

| | | | |
|---|---|---|---|
| 1,104,759 | 7/1914 | Sheahan . | |
| 1,676,305 | 7/1928 | Weldon . | |
| 1,688,267 | 10/1928 | Cram . | |
| 1,734,879 | 11/1929 | Read . | |
| 1,789,515 | 1/1931 | Cram et al. . | |
| 3,268,390 | 8/1966 | Ely | 162/306 |
| 3,529,755 | 9/1970 | Spangenberg et al. . | |
| 4,000,035 | 12/1976 | Schiel et al. | 162/290 |
| 4,014,740 | 3/1977 | Koponen et al. | 162/289 |
| 4,056,433 | 11/1977 | Koponen et al. | 162/359 |
| 4,359,827 | 11/1982 | Thomas | 34/16 |
| 4,501,643 | 2/1985 | Kluru | 162/286 |
| 4,502,231 | 3/1985 | Fissmann et al. | 34/114 |
| 4,526,655 | 7/1985 | Karvinen et al. | 162/360.1 |
| 4,543,160 | 9/1985 | Kurttula et al. | 162/193 |

FOREIGN PATENT DOCUMENTS

| | | |
|---|---|---|
| 8300514 | 2/1983 | World Int. Prop. O. . |
| 697338 | 9/1953 | United Kingdom . |

OTHER PUBLICATIONS

"Svensk Papperstidning", 1982, pp. 10–16.

"Wochenblatt fur Papierfabrikation", 1979, p. 17.

*Primary Examiner*—S. Leon Bashore

*Assistant Examiner*—Andrew J. Anderson

*Attorney, Agent, or Firm*—Anthony Niewyk; Albert L. Jeffers

[57] ABSTRACT

A paper machine where the press section features exclusively double felt roll presses (13–16; 23–26) through which proceeds the paper web (10) to be dehydrated between two felt belts (15,16; 25, 26). The paper web (10) is constantly supported by a backing belt (34) at least in the first drying group of the drying section. The transition of the paper web (10) from one roll press to the next and from the press section to the drying occurs without an open draw. The first drying cylinder (31) is located outside the backing belt loop (34), with the paper web (10) proceeding across the upper cyliner area of this drying cylinder (31). The entrance point of a rope carrier (45,46) (serving to thread the paper web into the drying section) is located behind the leaving point of the paper web (10) from the first drying cylinder (31).

14 Claims, 15 Drawing Figures

Fig. 3
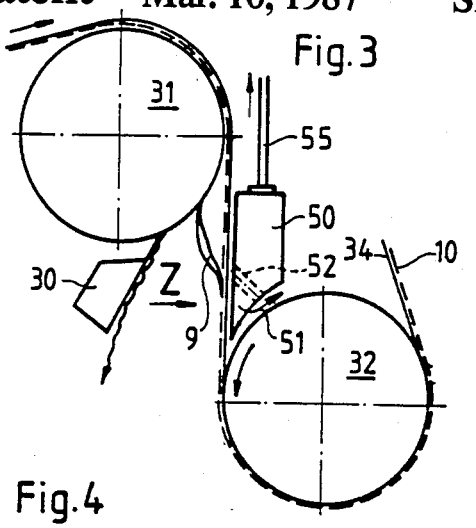
Fig. 3Z
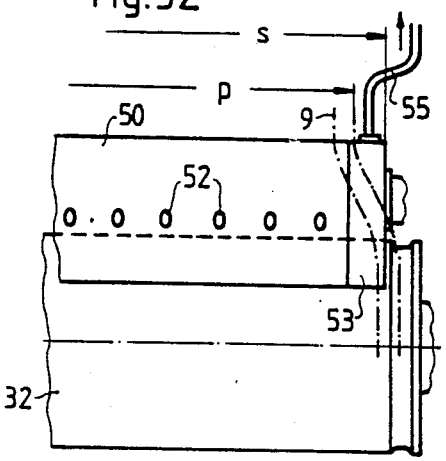
Fig. 4
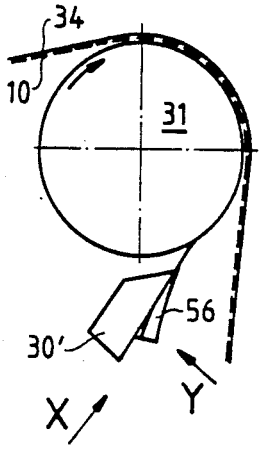
Fig. 4X
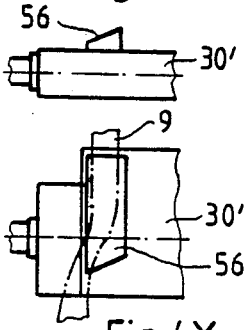
Fig. 4Y
Fig. 6
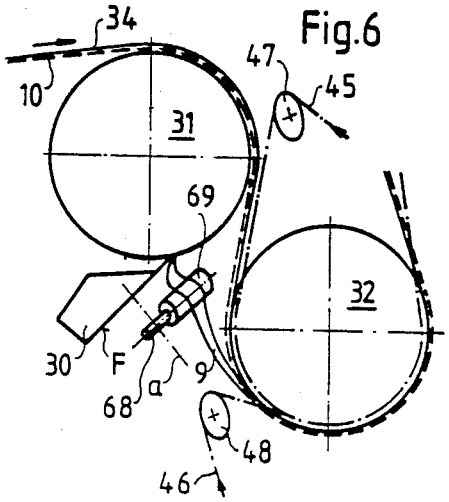
Fig. 7
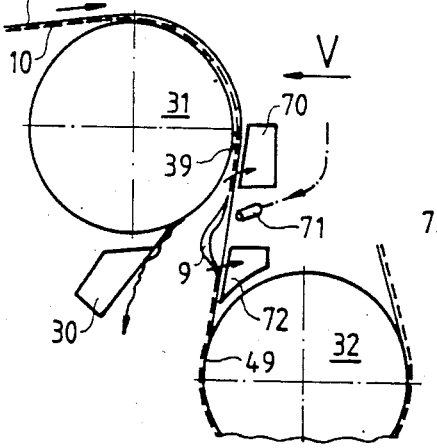
Fig. 7V
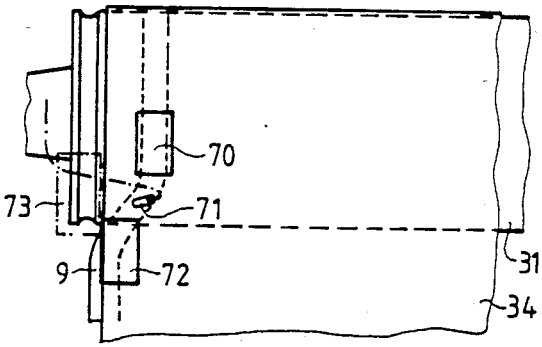

PAPER MACHINE

TECHNICAL AREA

The invention concerns a paper machine which is intended to be suited preferably for the production of mass papers (for instance printing paper, corrugated liners or similar) at maximum operating speeds.

STATE OF THE ART

1. DE-OS No. 33 33 040
2. WO No. 82/02937;
3. DE-PS No. 287 998;
4. DE-AS No. 25 38 846
5. DE-AS No. 23 65 438 (similar to U.S. Pat. No. 4,000,035);
6. WO No. 83/00514;
7. DE-OS No. 32 36 576.

The invention is based on the paper machine known from document 1. On that machine, the paper web runs successively through several press gaps and thereafter into the drying section, after it has been transferred from the web-forming screen with the aid of a felt belt. In each of the press gaps the paper web is located between two felt belts and is thus not in direct contact with any of the press rolls. Therefore, none of the press rolls needs to be a stone roll. (As generally known, a stone roll would in many cases have to be made from natural stone, causing extremely high cost. Besides, only a relatively low press force can be applied when using stone rolls.) Another advantage of the prior paper machine is that the paper web proceeding through the press section and transfering from the press section to the drying section is constantly supported by at least one of the felt belts and/or by the backing belt of the drying section, so that the still wet paper web is considerably less stretched in longitudinal direction than in other prior paper machines where an open draw exists between the press section and the drying section.

A similar prior paper machine is described in document 2. On this machine, the paper web runs together with the backing belt of the drying section first across the lower cylinder area of a first drying cylinder located within the backing belt loop. The arrangement according to document 1 is different: the paper web proceeds together with the backing belt first across the upper cylinder area of the first drying cylinder which is located outside the backing belt loop.

A disadvantage of the designs known from documents 1 and 2 is that the first "threading" of the paper web into the drying section (after a shut-down or web break) causes serious difficulties. Documents 1 and 2 do not mention this problem. The teaching of documents 3 and 4 is that a rope carrier be provided in the drying section with the aid of which a narrow edge strip of the paper web, the so-called transfer strip, is first introduced into the drying section. The remaining part of the paper web is passed from the web-forming screen or from one of the press rolls into a scrap container during this threading phase. Next, the transfer strip is broadened until it has assumed the width of the full paper web. As generally known, the rope carrier is located on the tending edge of the drying cylinders, and at that, outside the paper web width, with the entrance point into the rope carrier being arranged on or before the first drying cylinder. For that reason, the transfer strip must be deflected sideways from its normal path before the entrance point of the rope carrier (i.e., before the first drying cylinder). With the paper machines according to documents 1 and 2 this is difficult or not possible at all because the transfer strip runs on the backing belt as it enters the drying section. In other words:

The fact that the paper web runs according to documents 1 and 2 without open draw through the press section and from the press section into the drying section offers the advantage of reduced longitudinal stretching of the moist paper web, but grave disadvantages exist with regard to threading the paper web into the drying section.

SUMMARY OF THE INVENTION

The problem underlying the invention is improving the paper machines known from documents 1 and 2 to the effect that the "threading" of the paper web into the drying section can be performed with the aid of a rope carrier, without the above difficulties while the advantage of the continuous paper web backing with the correspondingly reduced longitudinal stretching of the still moist paper web is to be maintained.

This problem is solved through the characterizing feature of claim 1.

According to it, the entrance point into the rope carrier is relocated behind the leaving point of the paper web from the first drying cylinder. The entrance point of the rope carrier is preferably arranged only in the lower area of the second drying cylinder which is contained inside the backing belt loop (claim 2). This is because during the transfer process (i.e., during the threading of the paper web into the drying section) the transfer strip can be permitted, after passing of the common looping zone of the paper web and backing belt on the first drying cylinder, to run—deviating from the normal tangential path—separated from the backing belt running from the first to the second cylinder, along a free and curved path toward the second cylinder. In other words, the entire paper web including the transfer strip runs during the transfer process off the first drying cylinder later than the backing belt. This makes it possible to deflect the transfer strip between the first and second drying cylinders from its normal path sideways into the path of the rope carrier. During the transfer process, the remaining paper web runs off downward as scrap from the first drying cylinder. In other respects, the threading of the paper web into the drying section is handled the same as on prior paper machines.

Thus, the invention provides a paper machine combining the following advantages:

1. The press section features exclusively double felt presses so that no granite roll is required. This permits selecting higher pressures than on prior paper machines.

2. The longitudinal stretch of the paper web in the press section and during transfer into the drying section is considerably reduced (to about 1/10 of its previous value). The inevitable remainder is attributable to the fact that the various drives (for the presses and drying cylinder groups) must run at minor speed differentials. The first unsupported paper section (open draw) is located only in an area of the drying section where the paper possesses already a high dry content and a high strength.

3. Using a rope carrier located sideways of the paper web width is possible, so that threading the paper web into the drying section (while backed by a contact belt) is manageable without difficulty even at highest paper machine speeds (in the order of 1400 m/min).

The application of the invention may be particularly advantageous if according to claim 14 one of the roll presses is designed as a so-called extended gap press. In this case, the paper web adheres, after passing the press, more firmly to the felt belts than on conventional roll presses. Additionally, the invention makes it possible to replace, as the case may be, the previously provided suction press roll by a cheaper regular press roll.

Another device for threading the paper web into the drying section, with a contact felt carrier, is known from document 5, featuring a narrow carrier belt or rope which is capable of running through the drying section along two different paths, either sideways and outside the paper web width or at the edge of the paper web inside its width. Thus, the carrier belt can thread the transfer strip into the drying section within the paper width. Hence it is not necessary to sideways deflect the transfer strip. However, the carrier belt must be moved out of the paper web area once the threading is completed. Besides, it must be reintroduced into the paper web area for the next transfer process. Moving the carrier belt in and out represents for the operating personnel an additional, undesirable operation which hinders the swift restart of the paper machine after a web break. High operating speed involves the additional danger that the carrying belt might break due to frequently moving it in and out. Therefore, the "theoretically conceivable" application of the device according to document 5 on prior paper machines according to documents 1 and 2 would not result in a satisfactory solution.

Further favorable designs (refer to claims 3 through 13) and embodiments of the invention will be explained hereafter with the aid of the drawing.

BRIEF DESCRIPTION OF THE DRAWING

FIG. 3 shows a schematic side view of the two first drying cylinders along with one design variant.

FIG. 3Z shows a partial view in the direction of arrow Z in FIG. 3.

FIG. 4 shows a schematic side view of the first drying cylinder using another embodiment of the invention.

FIGS. 4X and 4Y show partial views in the direction of arrows X and/or Y in FIG. 4.

FIG. 5 W shows a view in the direction of arrow W in FIG. 5.

FIGS. 6 and 7 show schematic partial views of the first two drying cylinders with additional design variants.

FIG. 7V shows a partial view in the direction of arrow V in FIG. 7.

DESCRIPTION OF THE PREFERRED EMBODIMENTS

Figure 1:
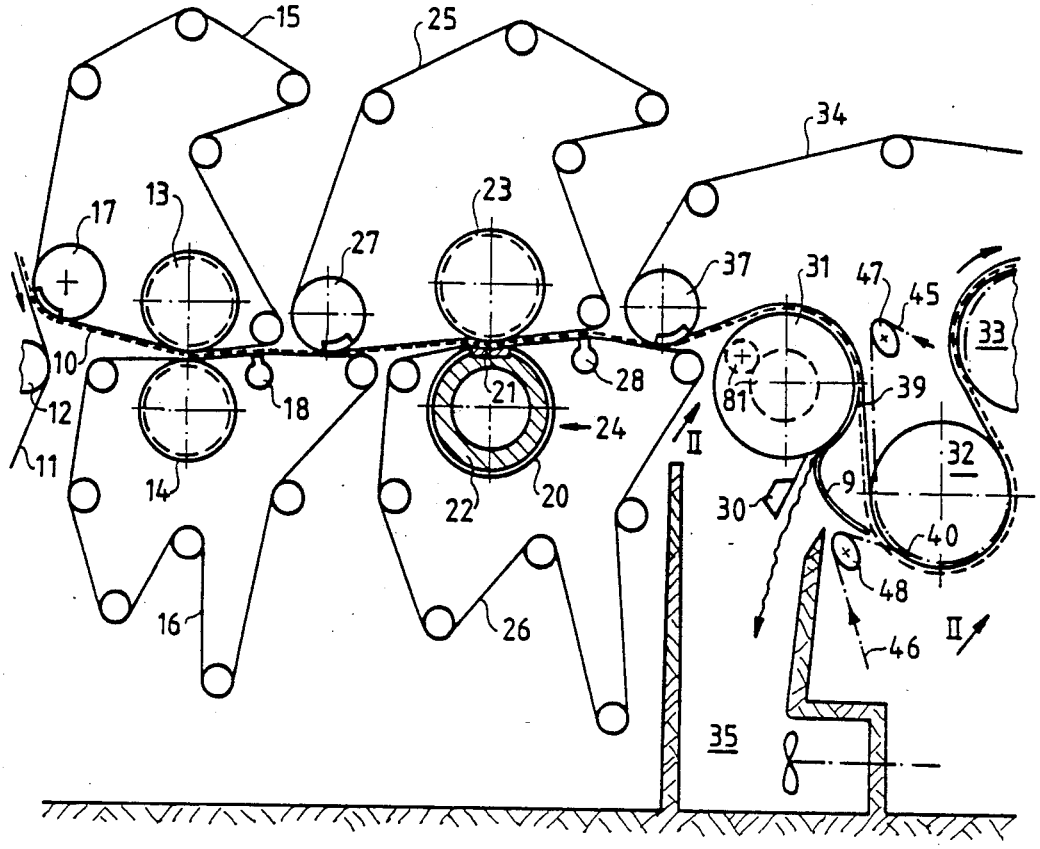
FIG. 1 shows a schematic partial view of a paper machine.

FIG. 1 presents the paper web 10 on its way through the paper machine as a dashed line. Of the screen section forming the paper web 10, only a small section of the endless screen 11 and one of the screen guide rolls 12 is visible.

In the press section, the paper web 20 passes first through a roll press composed of two press rolls 13 and 14 and two felt belts 15 and 16. The upper felt belt 15 runs across a lift-off suction roll 17 lifting the paper web 10 off the screen 11. The two felt belts 15 and 16 preferably run together with the intervening paper web 10 first out of the roll press 13, 14, and at that, up to a suction tube 18 which is arranged within the lower felt loop 16 and ensures that the paper web 10 continues to proceed together with the felt belt 16.

A second roll press comprises an upper press roll 23, a belt press unit 24, an upper felt belt 25 and a lower felt belt 26. Provided in the upper felt belt 25 is again a lift-off suction roll 27 which lifts the paper web 10 off the lower felt belt 16 of the first roll press. The belt press unit 24 may essentially consist of a fixed roll-shaped support body 22, a press shoe 21 and a revolving elastic press belt 20. The press roll 23 and the belt press unit 24 form a so-called extended gap press featuring a press gap which is extended in the travel direction of the paper web. The departure of felt belts 25 and 26 from the extended press gap may take place in the same fashion as in the first roll press. A suction tube 28 may again be provided for that purpose.

Instead of using a belt press unit 24, it would also be possible to provide a normal press roll (as in the first roll press). The cylinders of the press roll are preferably provided with blind bores, grooves or similar. Normally, none of the press rolls is designed as a suction roll.

Only the first three drying cylinders 31, 32, and 33 of the paper machine drying section are visible. A belt carrier 34 (screen, felt or similar) meanders across these drying cylinders. The first drying cylinder 31 is located outside the carrier belt loop, the second drying cylinder 32 is located inside, the third drying cylinder 33 is again located outside etc. The arrangement is such that the carrier belt 34 proceeds across the upper cylinder area of the drying cylinders 31 and 32 located outside and across the lower cylinder area of the drying cylinder 32 located inside. Provided inside the belt carrier loop 34 is a lift-off suction roll 37 which separates the paper web 10 from the lower felt belt 26 of the second roll press. The paper web continues then together with the carrier belt 34 across the drying cylinders 31, 32, 33. In the process, the paper web makes direct contact with the drying cylinders 31 and 33 located outside. On the inside drying cylinders 32, conversely, the backing belt 34 is contained between the cylinders and the paper web 10.

As follows from FIG. 1, the paper web is in the entire illustrated part of the paper machine constantly in contact with at least one belt (screen 11; felts 15, 16, 25, 26, or backing belt 34). In other words, an unsupported paper path section and the resulting longitudinal stretch of the paper web are avoided. As can also be seen, none of the press rolls 13, 14, 23, 24 is in contact with the paper web 10 in the press section. Thus, none of the press rolls need be a stone roll.

Figure 2:
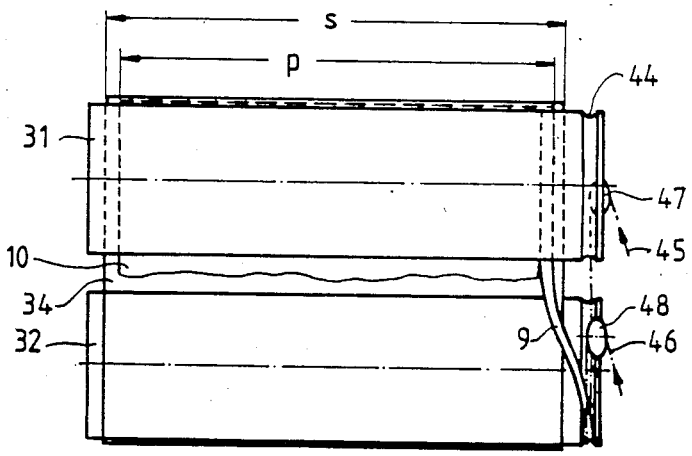
FIG. 2 shows a view of the first two drying cylinders of the paper machine presented in FIG. 1, in direction of arrows II—II in FIG. 1.

Provided for threading the paper web 10 into the drying section is a rope carrier which comprises an upper rope 45 and a lower rope 46. As follows from FIG. 2, the ropes 45 and 46 run on the drying cylinders 31, 32, 33 in rope grooves 44 which are provided on the tending side edge of the drying cylinders. The rope grooves 44 are located outside the paper web width p and also outside the backing belt width s. The endless ropes 45 and 46 return by way of pulleys 47 and 48. Recognizable in FIGS. 1 and 2 are the rope pulleys 47 and 48 which are located directly before the entrance point 40 of the rope carrier. The entrance point 40 is that point where the common path of the ropes 45 and 46 across the drying cylinders begins.

The rope pulleys 47 and 48 are inventionally so arranged that the entrance point 40 is located behind the leaving point 39 of the paper web 10 from the first drying cylinder 31. In the illustrated embodiment, the entrance point 40 of the second drying cylinder 32 is located in the lower cylinder area. The upper rope 45 does not touch the first cylinder 31 in the depicted arrangement, for which reason its groove pulley 44 remains unused. But it may also happen that the upper rope 45 loops around part of the circumference of the first cylinder 31.

Prior to its threading into the drying section, the paper web 10 proceeds at full width up to the first drying cylinder 31 and is removed from its surface with the aid of a blade 30 and passed into a scrap vat 35. Next, a transfer strip 9 is separated with the aid of a (not illustrated) water jet pipe which is located within the screen section. The transfer strip may now be introduced, between the first two drying cylinders 31, 32, into the entrance point 40 of the rope carrier, with the strip travelling temporarily along the spatially curved path illustrated in FIGS. 1 and 2. Thereafter, the transfer strip 9 resumes again its normal path within the paper web width p. The loop illustrated in FIG. 1, at 9, is eliminated in the process by a small speed differential between the two drying cylinders 31 and 32. The first drying cylinder possesses for that purpose a drive of its own which is independent of the other cylinders 32, 33 and illustrated (only in FIG. 1) symbolically by dashed circles representing a drive 81. Lastly, the water jet pipe mentioned above is moved crosswise through the paper machine allowing the transfer strip to widen until the paper web 10 runs at full width through the drying section.

The following applies to FIGS. 1 and 2, and also for the other embodiments according to FIGS. 1A through C and 3 through 7: a roller with a smooth surface could be provided instead of the first drying cylinder 31. A roller with a plastic coating (for instance Teflon) is preferably chosen, to which the moist paper web adheres only slightly. The lower drying cylinders (for instance 32) could be replaced by suction felt guide rollers according to document 6 or by normal, solid guide rolls which, if so required, feature circumferential grooves or similar recesses in the roll cylinder.

Figure 1A:
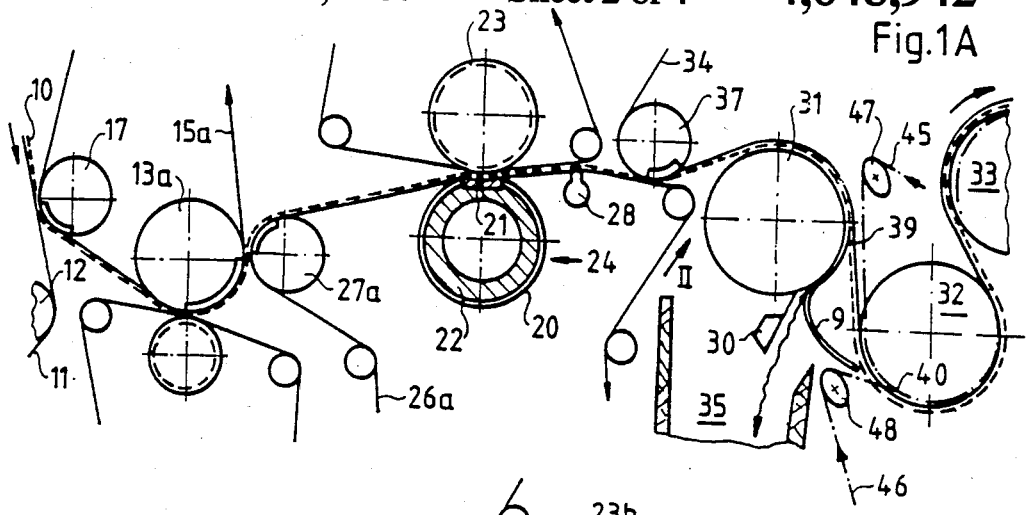
FIGS. 1A through 1C shows schematic partial views of other paper machines where the invention has been realized.
Figure 1B:
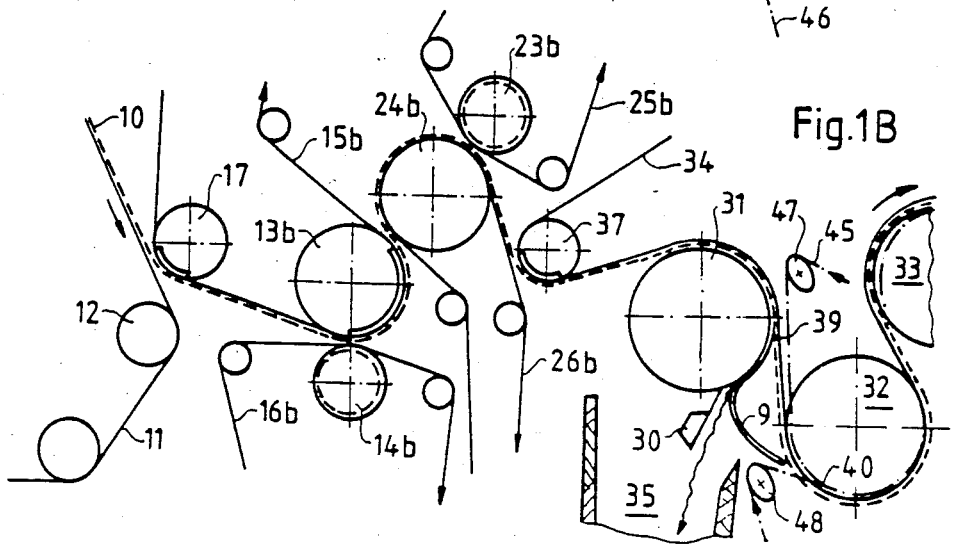
Figure 1C:
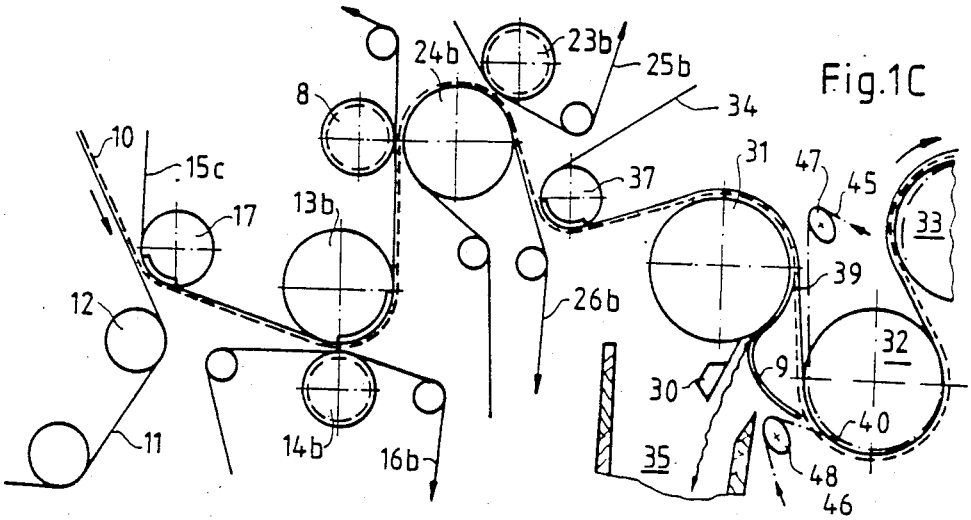

FIGS. 1A through 1C show that the invention can be used also in various other press section designs. The initial area of the drying section with cylinders 31, 32, 33, with the backing belt 34 and the scrap vat 35 is unchanged in FIGS. 1A through 1C as against FIGS. 1 and 2.

The embodiment according to FIG. 1A differs from that presented in FIG. 1 essentially only by the following characteristics: The upper press roll **13*a* of the first roll press is designed as a suction press roll causing the paper web 10 to run first, behind the press gap, upward with the upper felt 15. The liftoff suction roll 27*a* of the second roll press is arranged within the lower felt 26*a* and separates the paper web 10 from the upper felt 15*a*** of the first roll press.

The press section according to FIG. 1B is essentially designed the same as that in document 1. Four press rolls **13*b*, 14*b*, 23*b*, *and 24b* are combined to a compact press with three press gaps. Modeled on FIGS. 1 and 2, the felt belts are marked 15, 16*b*, 25*b*, and 26*b***.

Known as such, an advancement of the press section presented in FIG. 1B is shown in FIG. 1C. The difference is that a vertical spacing is provided between the press rolls **13*b* and 24*b* and that an additional press roll 8 is arranged in the loop of the first upper felt belt 15*c*, which interacts with the press roll 24*b***.

FIGS. 3 and 3Z show how the deflection of the transfer strip 9 may be accomplished with the aid of a so-called air carrier box 50. Such a box is previously known as such from the patent document 7 and is also called a "web stabilizer." The same as in FIG. 1, the paper web 10 proceeds together with the backing belt 34 across the first two drying cylinders 31 and 32. The rope carrier is present the same as in FIG. 1; but it was omitted in FIGS. 3 and 3Z. The air carrier box 50 is arranged on the backing belt 34 side not exposed to the paper web 10. In the normal operation of the paper machine it serves to keep the paper web 10 on the backing belt 34. Through a not illustrated line, blasting air is fed to the air carrier box 50 and discharges, through numerous nozzles (arrows 51) distributed across the machine width, on the cylinder surface of the second cylinder 32 opposite to its direction of rotation. Created thereby, in the space between the air carrier box 50 and the backing belt 34 is a suction which is further increased by a number of cross channels 52. This vacuum causes the mentioned retention of the paper web 10 on the backing belt 34.

Provided especially for deflecting the transfer strip 9, on the tending end of the air carrier box 50, is a separate vacuum zone 53. It is located at least predominently outside the normal paper web width p. The separate vacuum zone 53 is split from the remaining part of the air carrier box 50 through a sealing strip 54 extending in the travel direction of the backing belt 34 and making contact with it. The vacuum in the separate zone 53 may be generated either in the same way as in the remaining part of the air carrier box 50 or with the aid of an additional suction line 55.

FIGS. 4, 4X and 4Y show an embodiment of a device for the automatic sideways deflection of the transfer strip 9. The blade mentioned above and making contact with the underside of the first drying cylinder 31, and which is now marked 30', possesses for that purpose in the path of the transfer strip 9 a guide face 56. It has a curvature similar to that of a plow blade and deflects the transfer strip 9 to the plane of the rope carrier, immediately after being stripped from the face of the cylinder 31 by the blade 30'; refer to FIG. 4Y.

Figure 5:
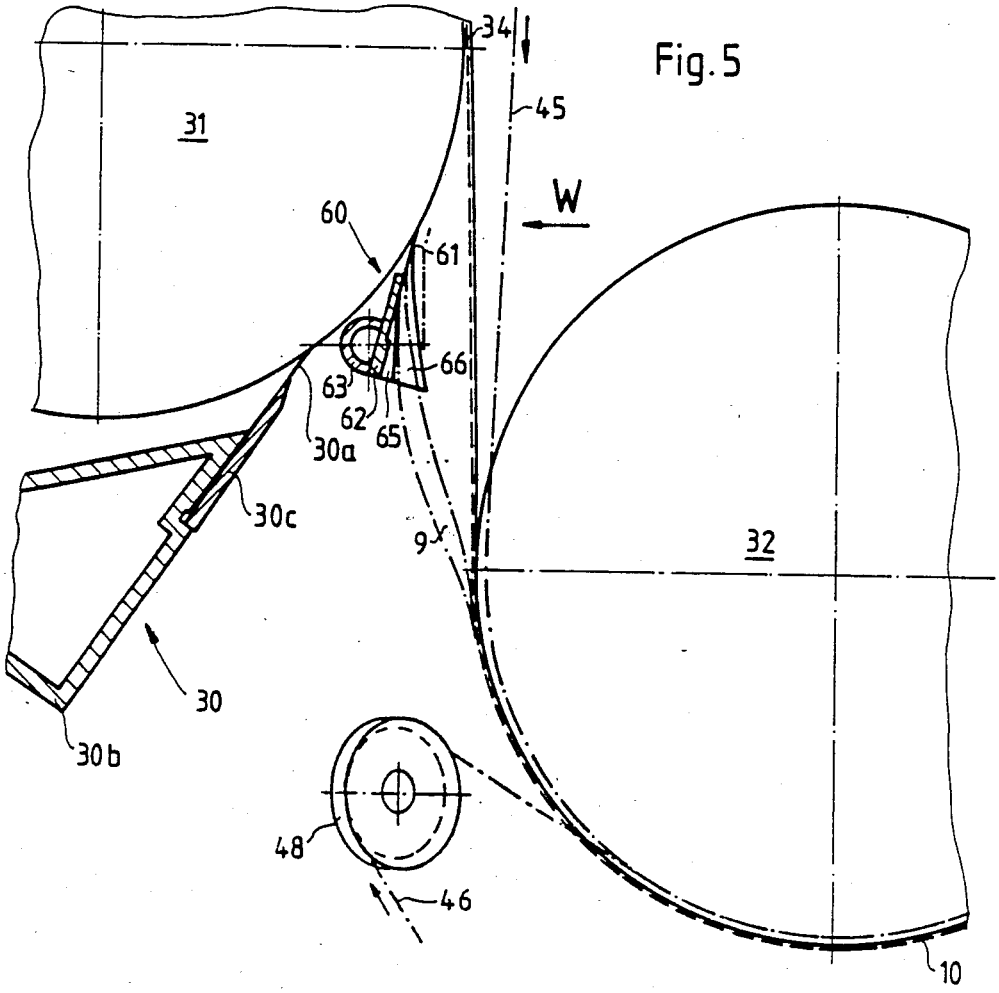
FIG. 5 shows an embodiment similar to the example in FIG. 4.
Figure 5W:
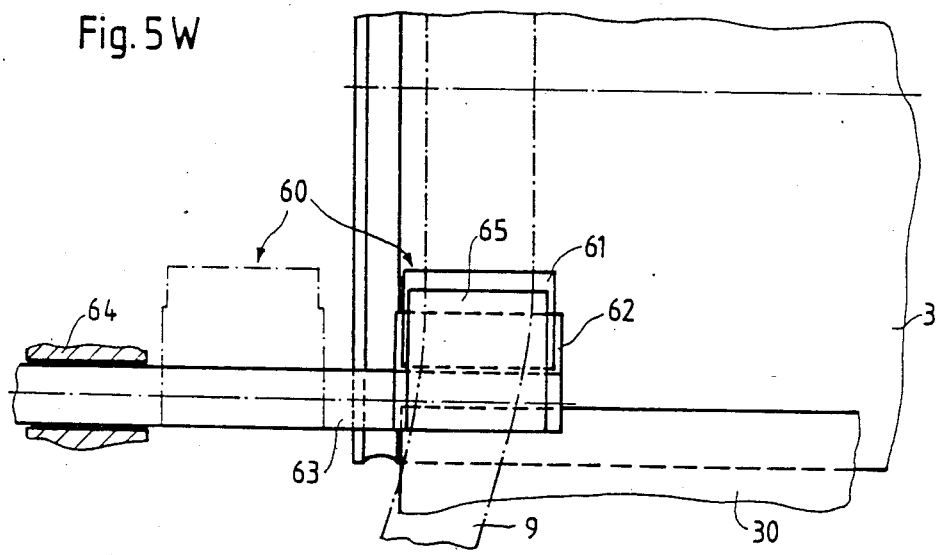

More favorable yet, a similar design is illustrated in FIGS. 5 and 5W. In addition to the blade 30 extending as previously across the entire machine width, a so-called marginal strip blade 60 is provided now.

Firstly, as can be seen from FIG. 5, the blade 30 features a knife **30*a* which is mounted on the blade bar 30*b* with the aid of a clamping strip 30*c*. The marginal strip blade 60 is of a similar design but has smaller dimensions. The length of the knife 61 is only slightly larger than the width of the marginal transfer strip 9. The blade body 62 supporting the knife comprises a support arm 63. With it, the marginal strip blade 60 is mounted in an only schematically illustrated bearing 64 making the blade 60 (as indicated in FIG. 5) both sideways adjustable (as indicated in FIG. 5W) and also allowing it to be swiveled by a small angle. Thus, the marginal strip blade 60 may remain sideways outside the paper width area during the normal paper machine operation and can be moved during the transfer process into the gore between the cylinder 31 and the backing belt 34 and applied on the face of the cylinder 31. For the sideways deflection of the transfer strip 9, the marginal strip blade 60 features a guide element 65 with a guide face 66 which again has a curvature similar to a plow share and deflects the transfer strip 9 into the path of the rope carrier. The guide element may likewise serve the mounting of knife 61 on the blade body 62**.

FIG. 6, similar to FIG. 1, shows again the first two drying cylinders 31 and 32 and the entrance area of the rope carrier 45 through 48, and additionally the paper web 10, backing belt 34, and the blade 30. Additionally, there is now a guide roll 69 provided whose length is somewhat larger than the width of the transfer strip 9. The guide roll 69 is rotatably mounted on a stud 68; if required, it may be powered. The stud 68 is supported sideways, beside the paper machine by a not illustrated swivel bearing. The axis a of this bearing extends approximately perpendicular to the face F of the blade 30 but somewhat outside the web length of the cylinder 31. In the inoperative position, that is, during the normal operation of the paper machine, the axis of rotation of the guide roll 69 extends approximately parallel with the axis of rotation of the first cylinder 31, with the guide roll itself extending below the cylinder 31 some way into the area of the paper web width p. During the transfer process, that is, when the paper web proceeds downward on the cylinder 31 and the blade 30, the guide roll is swiveled upward at an angle around the axis a so that it will take hold of the transfer strip 9 and deflect it sideways, that is, in outward direction into the path of the rope carrier 45, 46.

The embodiment illustrated in FIGS. 7 and 7V features the following for the sideways deflection of the transfer strip 9: Arranged at the leaving point 39 of the transfer strip 9 from the first cylinder 31, on the backing belt 34, is a small suction box 70 which is only slightly wider than the width of the transfer strip 9. This suction box 70 is during the transfer process connected to a not illustrated vacuum force causing the marginal strip 9 to not continue to proceed with the cylinder 31, but with the backing belt 34. Arranged underneath the suction box 70 (also on the backing belt 34 side not exposed to the paper web) is a blasting pipe 71 which is capable of separating the marginal strip 9 from the backing belt 34. The blowing direction of the blasting pipe 71 is so angled that the marginal strip is being guided sideways and outward into the path of the rope carrier. To ensure that the marginal strip will be automatically grabbed by the rope carrier at maximum reliability, another suction box 72 may be arranged below the blasting pipe 71, immediately before the leaving point 49 of the backing belt 34 from the second drying cylinder 32, at the extreme outer edge of the backing belt 34. This box holds the marginal strip 9 on the backing belt 34, but with the marginal strip running approximately with its outer half outside the backing belt so that it will be safely grabbed by the rope carrier. Instead of the blasting tube 71, or in addition to it, a suction box 73 may be arranged sideways beside the tending side edge of the backing belt 34, which box will suck the marginal strip in outward direction.

What is claimed is:

1. Paper machine with a press section and a drying section and with the following characteristics:

(a) The press section is free of any press roll touching the paper web, that is, there are exclusively double felt roll presses used through which proceeds the paper web (10) which is to be dehydrated, between two felt belts (15/16; 25/26);

(b) in the area following the press section, of the drying cylinders (31, 32 33) of the drying section, the paper web (10) is carried constantly by a backing belt (34);

(c) the orbital path of the backing belt (34) is tangent to the orbital path of one of the felt belts (26; **26*a*; 26*b*) of the press section, in a way such that it transfers the paper web (10**) without any open draw from the press section to the drying section;

(d) the first drying cylinder (31) following the press section is located outside the endless loop of the backing belt (34), with the paper web (10) proceeding with the backing belt (34) across the upper cylinder area of this drying cylinder (31); characterized in that (e) a rope carrier (45,46) located outside the paper web width (p) and serving the threading of a paper marginal strip (9) into the drying section is so arranged that the entrance point (40) of the marginal strip (9) into the rope carrier is located behind the leaving point (39) of the paper web (10) from the first drying cylinder (31).

2. Paper machine according to claim 1, characterized in that the entrance point (40) of the rope carrier (45,46) is arranged in the lower area of the second drying roller (32) of the drying section located inside the backing belt loop.

3. Paper machine according to claim 1, characterized in that the lower cylinder area of the first cylinder (31) is free of the backing belt (34) and includes a blade (30) for stripping the paper web (10) off during the threading process.

4. Paper machine according to one of the claims 1, 2 or 3, characterized in that the first drying cylinder (31) includes a drive (81) which can be controlled separately from the other drying cylinders (32, 33).

5. Paper machine according to one of the claims 1, 2 or 3, where an air carrier box (50) is arranged between the first drying cylinders (31 and 32) on the backing belt (34) side not in contact with the paper web (10), which box retains the paper web (10) on the backing belt (34) through generating a vacuum, characterized in that the air carrier box (50) includes in the area of the marginal paper strip (9) a separate vacuum zone (53) which is located at least predominently outside the normal paper web width (p).

6. Paper machine according to one of the claims 1, 2 or 3, characterized in that in the area of the marginal paper strip (9), below the first drying cylinder (31), there is provided a guide device (56;60;69;70–72) which automatically causes the sideways deflection of the marginal paper strip (9) from its normal path to a temporarily spatially curved path into the path of the rope carrier (45, 46).

7. Paper machine according to claim 6, characterized in that the guide device is designed as a marginal strip blade (60) which is arranged on the first drying cylinder (31) and has a curved guide face (66) causing the sideways deflection of the marginal strip (9).

8. Paper machine according to claim 6, characterized in that the guide device is fashioned as a guide roll (69)

whose axis of rotation can be adjusted to an oblique position in accordance with the spatially curved path of the marginal paper strip (9).

9. Paper machine according to claim 6, characterized in that the guide device (60;69) can be swiveled back and forth between an operating position and an inoperative position.

10. Paper machine according to claim 6, characterized in that the guide device is fashioned as a spatially curved guide face (56) which is arranged on a blade (30') located in the lower cylinder area of the first cylinder (31) and causes the sideways deflection of the marginal strip (9).

11. Paper machine according to one of the claims 1, 2 or 3, characterized in that for sideways deflection of the marginal paper strip (9) from its normal path into the path of the rope carrier (45,46) the following is provided:

(a) located at the leaving point (39) of the marginal strip (9) from the first drying cylinder (31) on the backing belt (34) side not in contact with the paper web, a marginal strip suction device (70) for retaining the marginal strip (9) on the backing belt (34);

(b) located in travel direction behind the suction device (70), a separating and deflection device (71), for separating the marginal strip (9) from the backing belt (34) and sideways deflecting it toward the path of the rope carrier (45;46).

12. Paper machine according to claim 11, characterized in that directly before the run-on point (49) of the backing belt (34) on the second drying roller (32) there is located, on the extreme outer edge of the backing belt (34), a second suction device (72) for again retaining the marginal strip (9) on the backing belt (34), with the outer area of the marginal strip proceeding in the plane of the rope carrier (45;46).

13. Paper machine according to claim 11, characterized in that as separating and deflecting device there is arranged, sideways beside the edge of the backing belt (34), a transverse suction device (73).

14. Paper machine according to claims 1, 2 or 3, characterized in that one of the roll presses, is fashioned as an extended gap press, that is, the press gap extended in the travel direction of the paper web is formed between a normal press roll (23) and a revolving press belt (22) which can be forced on the press roll (20).

* * * * *